US011007791B2

(12) United States Patent
Heath

(10) Patent No.: US 11,007,791 B2
(45) Date of Patent: May 18, 2021

(54) MULTI-LAYERED TEXTURED PRINTING

(71) Applicant: Electronics for Imaging, Inc., Fremont, CA (US)

(72) Inventor: Peter Heath, Alexandria, NH (US)

(73) Assignee: ELECTRONICS FOR IMAGING, ING., Fremont, CA (US)

( * ) Notice: Subject to any disclaimer, the term of this patent is extended or adjusted under 35 U.S.C. 154(b) by 0 days.

(21) Appl. No.: 14/548,259

(22) Filed: Nov. 19, 2014

(65) Prior Publication Data

US 2016/0136982 A1 May 19, 2016

(51) Int. Cl.

| | |
|---|---|
| ***B41J 2/21*** | (2006.01) |
| ***B41J 29/13*** | (2006.01) |
| ***G03G 15/22*** | (2006.01) |
| ***B41J 3/407*** | (2006.01) |

(52) U.S. Cl.

CPC ..... *B41J 2/2117* (2013.01); *B41J 3/4073* (2013.01); *B41J 29/13* (2013.01); *G03G 15/224* (2013.01)

(58) Field of Classification Search

None

See application file for complete search history.

(56) References Cited

U.S. PATENT DOCUMENTS 5,111,302 A * 5/1992 Chan ..... H04N 1/52 347/15
5,608,439 A * 3/1997 Arbeiter ..... B41J 2/04551 347/102
7,384,667 B2 * 6/2008 Blanco ..... B44F 11/02 345/419
2002/0186383 A1 12/2002 Obrador
2003/0039499 A1 2/2003 Kelley et al.
2003/0214555 A1 11/2003 Teshigawara et al.
2004/0153204 A1 8/2004 Blanco
2004/0256754 A1 * 12/2004 Koguchi ..... B41J 3/4073 264/40.1
2006/0158473 A1 7/2006 Mills et al.
2011/0157272 A1 6/2011 Ikehata et al.
2011/0216110 A1 9/2011 Kunimine et al.
2011/0222081 A1 * 9/2011 Yi ..... G06T 17/00 358/1.9

(Continued)

FOREIGN PATENT DOCUMENTS

CN 1105409 A 7/1995
CN 1425098 A 6/2003

(Continued)

*Primary Examiner* — Alejandro Valencia
(74) *Attorney, Agent, or Firm* — Perkins Coie LLP

(57) ABSTRACT

The disclosure is related to printing an image as a multi-layered textured image on a substrate. The printing system prints one or more layers of a texture of the image as a base layer on the substrate and the image above the base layer. The base layer includes one or more layers of the texture. The printing system prints the texture using the ink from the print heads of the printing system. The process of printing a multi-layered textured image can include printing one or more layers of texture as a base layer on the substrate, printing one or more layers of white ink above the base layer, and printing one or more layers of the image above the white layers. The printing system can also insert one or more blank layers between different types of layers, e.g., texture layers, white layers and image layers.

2 Claims, 13 Drawing Sheets

(56) References Cited

U.S. PATENT DOCUMENTS

| | | | | |
|---|---|---|---|---|
| 2012/0081461 | A1* | 4/2012 | Kakutani | B41J 2/2117 347/43 |
| 2012/0107007 | A1 | 5/2012 | Qiao et al. | |
| 2014/0087151 | A1* | 3/2014 | Davidson | B41J 3/407 428/195.1 |
| 2014/0255645 | A1* | 9/2014 | Shumaker | B05C 9/022 428/99 |
| 2014/0272334 | A1 | 9/2014 | Riebel et al. | |
| 2015/0002567 | A1* | 1/2015 | Miller | B41M 5/0047 347/15 |

FOREIGN PATENT DOCUMENTS

| | | | |
|---|---|---|---|
| CN | 103342030 | A | 10/2013 |
| WO | WO-2014145440 | | 9/2014 |

* cited by examiner

MULTI-LAYERED TEXTURED PRINTING

TECHNICAL FIELD

The disclosure is related to ultraviolet inkjet printing, and more specifically, to printing a multi-layered textured image.

BACKGROUND

Certain types of printing systems are adapted for printing images on large-scale print media, such as for museum displays, billboards, sails, bus boards, and banners. Some of these systems use so-called drop on demand ink jet printing. In these systems, a piezoelectric vibrator applies pressure to an ink reservoir of the print head to force the ink out through the nozzle orifices positioned on the underside of the print heads. A set of print heads are typically arranged in a row along a single axis within a print head carriage. As the carriage scans back and forth along the direction of the print head axis, the print heads deposit ink across the width of the substrate. A particular image is created by controlling the order at which ink is ejected from the various nozzle orifices.

Some of these systems use inks with different colors to create the desired image. For instance, black, yellow, cyan, and magenta colored inks are commonly employed alone or in combination to generate the image. Thus, combinations of these four colors are used to create various other colors. Some of these printers are also used for textured printing, that is, printing images having a texture. For example, images are printed on surfaces that are rough, grainy or have a particular pattern. The current printers print textured images using techniques such as 3D Inkjet printing with or without support material, small format multiple pass texture printing, vacuum forming after printing, texturing by casting/molding and then inkjet printing. These techniques are either slow, complicated—involves significant amount of labor, resources, etc., or expensive.

Further, some of these techniques use white ink or fillers to form a texture layer. Some of them form the texture using solid or composite color materials, colored binder in powder. Some of them form the texture after screen printing or inkjet printing, or print onto molded/cast texture. However, these do not provide a method for printing base relief images.

SUMMARY

The disclosure is related to printing a multi-layered multi-pass textured image using a printing system. An image such as an image of a topographical map can be printed as a textured image, e.g., having a texture where the mountains are taller than the flat lands, desert regions are grainy, water bodies are smooth. An image can be printed with various types of texture. For example, an image of a mountain in the topographical map can be printed as a flat image, or having a particular height or having a rough surface, etc. To print an image with a particular texture, the texture can be specified using a first image file (also referred to as "texture file"), which can then be combined with a second image file (also referred to as "image file") of the image to generate a combined file (also referred to as "textured image file"), which when input to the printing system prints the textured image.

The image file, the texture file and the textured image file are of a format understandable by the printing system. In some embodiments, the format understandable by the printing system is a raster transfer language (RTL) format. The RTL is a subset of the printer command language (PCL), which is a printer protocol for printing. In some embodiments, the image file and/or the texture file may not be of the RTL format, in which case they are converted to the RTL format before the textured image file is generated. Some example formats in which the image file and/or the texture file may exist include bitmap (.bmp), graphics interchange format (gif), Joint Photographic Experts Group (JPEG), tagged image file format (TIFF), portable network graphics (PNG). Further, the RTL is just one example of the format that is understandable by the printing system. The printing system can receive files of various formats other than RTL. Prior to printing the textured image, the image file and the texture file are converted to RTL files, if they are not in RTL format, and they are then processed to generate the textured image file in the RTL format.

The printing system prints the textured image as multi-layered and in multiple passes. The multi-layered textured image can have one or more layers of texture, one or more layers of white ink and one or more layers of the image. The higher the number of texture layers, the taller is the texture in the resulting textured image. In some embodiments, the processing of printing the multi-layered text image includes printing the texture layers first, then printing one or more white layers on the texture, and then printing the image on the white layers. The texture layers are printed using one or more colors of ink in the printing system. In some embodiments, the texture layer is coated with one or more white layers before printing the image in order to provide a bright background to the image. Since the texture layers are printed using various colors, the texture layer can be dark and if the image is printed on the dark layers, the image not be visible properly. So the texture layer is coated with one or more layers of white color and then the image is printed on the white layers. In some embodiments, if the height of the texture is higher than a specified threshold, a printing carriage of the printing system consisting of print heads that deposit the ink is raised before the next layer is printed, hence referred to as multi-pass printing. The carriage can be raised a specified number of times to accommodate taller textures.

In some embodiments, the image can also be printed in multiple layers. The higher the number of layers of the image, the darker and finer the image looks. The number of texture layers and/or the image layers can be specified by a user, e.g., using a printing application that is used to print the textured image. The printing application can be executing on any of the printing system or a computer connected to the printing system using which the print command is executed. The printing application includes a graphical user interface (GUI) that allows the user to select a texture, an image, specify the number of layers for the texture and/or the image, number of layers of white ink, etc. The RTL file of the textured image file includes the necessary information, e.g., above information regarding the layers, and instructions for the printing system to print the textured image accordingly.

DETAILED DESCRIPTION

Figure 1A:
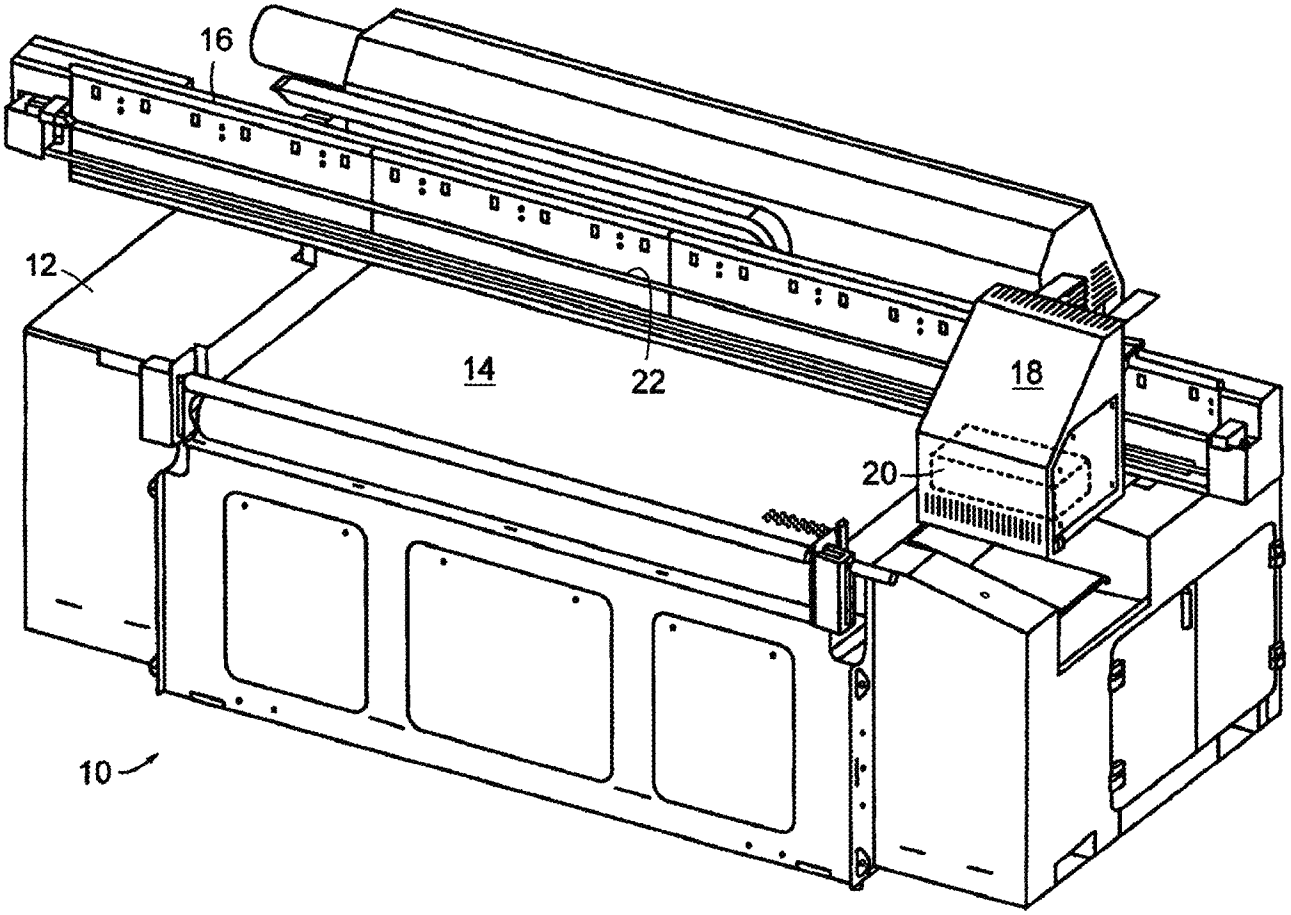
FIG. 1A is a printing system in which a method of multi-layered textured printing of an image can be implemented.

FIG. 1A is a printing system in which the method of textured printing can be implemented. The printing system 10 includes a carriage 18 that holds a series of ink jet print heads 20 configured for printing images on a variety of substrates. Exemplary substrates include glass, wood, acrylic, and plastic substrates. The inks deposited may be solvent-based inks, or radiation (e.g., ultra-violet "UV") curable inks. In addition to the carriage 18, the printing system 10 includes a base 12, a transport belt 14 that moves a substrate positioned on top of the belt 14 through the printing system 10, and a rail system 16 attached to the base 12. The carriage 18 is attached to a belt 22 which is wrapped around a pair of pulleys positioned on either end of the rail system 16.

Figure 2:
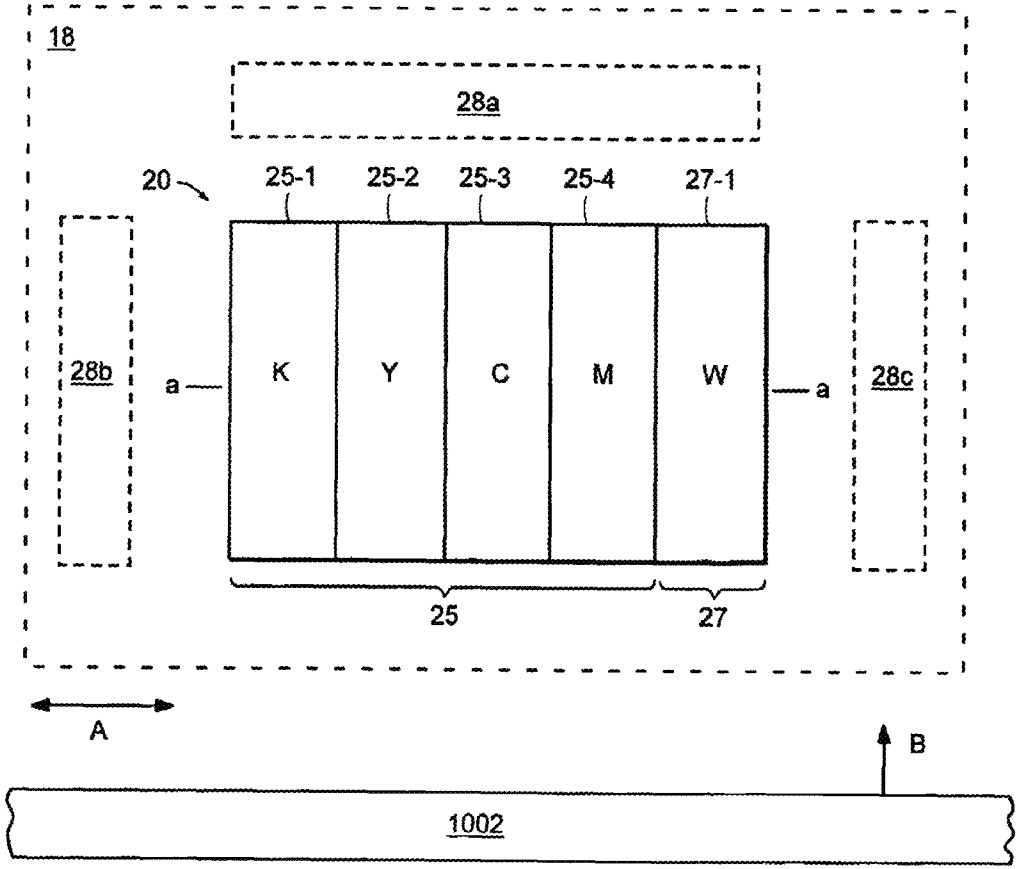
FIG. 2 is a block diagram illustrating an arrangement of print heads in a printing system of FIG. 1, consistent with various embodiments.

A carriage motor is coupled to one of the pulleys and rotates the pulley during the printing process. Accordingly, as the transport belt 14 intermittently moves the substrate, e.g., substrate 1002 of FIG. 2, underneath the carriage 18, and hence the series of print heads 20, the pulleys translate the rotary motion of the motor to a linear motion of the belt 22 thereby causing the carriage 18 to traverse back and forth along the rail system 16 across the substrate 1002 as the series of ink print heads 20 deposit ink onto the substrate 1002. More particularly, as illustrated in FIG. 2, the carriage 18 moves back and forth as indicated by the arrow A as the substrate 1002 moves intermittently in the direction of arrow B underneath the print heads 20. In some embodiments, the carriage 18 can also be raised in height to print on materials of varying thicknesses, or to accommodate textured printing. For example, if the image printed on the substrate 1002 is a textured image where the texture has a particular height, the carriage 18 can be raised to print on the raised texture. Further, the substrate 1002 can be moved in either direction—forward or backward to print in both directions.

Figure 1B:
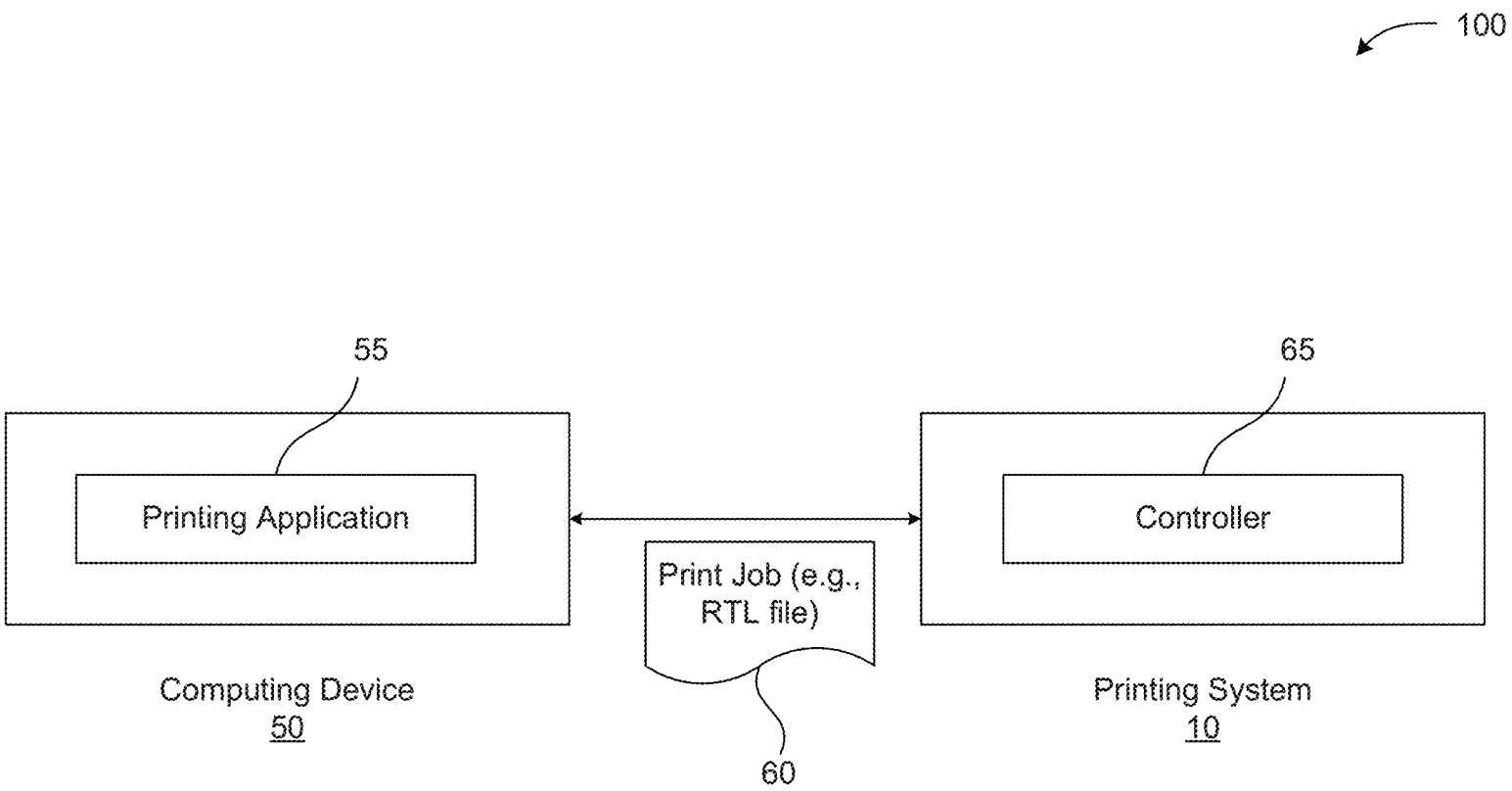
FIG. 1B is a block diagram of an environment in which the printing system of FIG. 1 can be used to print the multi-layered textured image, consistent with various embodiments.

FIG. 1B is a block diagram of an environment 100 in which the printing system of FIG. 1 can be used to print the multi-layered textured image, consistent with various embodiments. The computing device 50 includes a printing application 55 that can generate a print job, such as the print job 60, for printing a multi-layered textured image. In some embodiments, the print job 60 is in the RTL format. The printing system 10 includes a controller 65 that controls and/or instructs the print heads 20 to print the multi-layered textured image according to the print job 60. The printing system 10 includes a memory (not illustrated) to store the print job 60.

FIG. 1B illustrates the printing application 55 as implemented in the computing device 50. However, it should be noted that the implementation of the printing application 55 is not limited to the above configuration. For example, a portion of the printing application 55 can be implemented in the printing system 10. In another example, the printing application 55 can be implemented entirely in the printing system 10.

FIG. 2 is a block diagram illustrating an arrangement of print heads in a printing system of FIG. 1, consistent with various embodiments. Print heads 20 generally include multiple groups of print heads, e.g., group 25 and group 27, forming separate printing channels. The first group of print heads 25 forms the first printing channel and includes a series of print heads for printing multi-colored images using colored inks. In the embodiment shown in FIG. 2, the first group of print heads 25 includes four print heads, 25-1, 25-2, 25-3 and 25-4, for printing black (K), yellow (Y), cyan (C), and magenta (M) inks, respectively. In practice, the first group of print heads 25 typically will include more than four print heads. For example, the first group of print heads 25 may include eight print heads, with pairs of print heads for printing each of the black (K), yellow (Y), cyan (C), and magenta (M) inks, respectively. In other embodiments, the first group of print heads 25 may include sixteen print heads, divided into sub-groups of four print heads each for printing each of the four different colored inks.

In some embodiments, the first group of print heads 25 may include additional print heads, or sub-sets of print heads, for depositing more than four colors. A person of ordinary skill in the art will understand that the first group of print heads 25 may include less than four print heads. In addition, a person of ordinary skill in the art will understand that the first group of print heads 25 may use less than or other than the four colors shown.

The second group of print heads 27, forming the second printing channel, includes at least one print head 27-1 for depositing a specialized printing fluid onto the substrate 1002. In the embodiment of FIG. 2, print head 27-1 may be used to deposit a substantially white ink (W) onto the substrate 1002. A person of ordinary skill in the art will understand that the second group of print heads 27 may include more than one print head, e.g., two print heads for printing white ink, and may include a set of print heads for depositing a printing fluid. In addition, a person of ordinary skill in the art will understand that instead of or in addition to a substantially white ink, the second group of print heads may deposit other printing fluids and combinations of such fluids onto the substrate 1002, such as clear protective coatings, anti-graffiti coatings, adhesives, gloss coatings, and anti-gloss coatings.

As shown in FIG. 2, the first group 25 and the second group 27 of print heads are positioned adjacent to one another in carriage 18, and aligned along an axis "a-a" that is substantially parallel to the direction of arrow A, which is the direction of travel of the carriage 18. The carriage 18 may also contain, or have associated with it, one or more radiation sources 28, such as a UV lamp or a light emitting diode ("LED") source, to partially or fully cure the inks or other printing fluids after they are deposited onto the substrate 1002. For example, radiation source 28*a* may be located adjacent to the trailing edge of the series of print heads 20 for applying radiation to the deposited fluids as the substrate 1002 moves through the system. Similarly, radiation sources 28*b*, 28*c* may be positioned laterally adjacent to the series of print heads 20 for partially or fully curing the deposited fluids.

The arrangement shown in FIG. 2 advantageously allows for sequential, multi-channel/multi-layer printing operations using a single series of print heads 20 aligned along a single print head axis "a-a." For example, apparatus and methods in accordance with this disclosure may perform both printing texture of a textured image and an image of the textured image using the inks of the print heads 20. Further, the texture and/or the image can be printed as a single layer or as multi-layers as described below. As described previously, the method of printing a textured image involves depositing multiple layers of ink on the substrate 1002, which can include one or more layers of ink of specified colors for the texture, one or more layers of substantially white ink over the texture, and one or more layers of colored inks forming the image on the white ink layer. In some embodiments, one or more layers may be blank, e.g., between the texture and the white ink layer(s) and between the white ink layer(s) and the colored ink layer(s) of the image. In the blank layer, no ink is printed on the substrate 1002.

Figure 3:
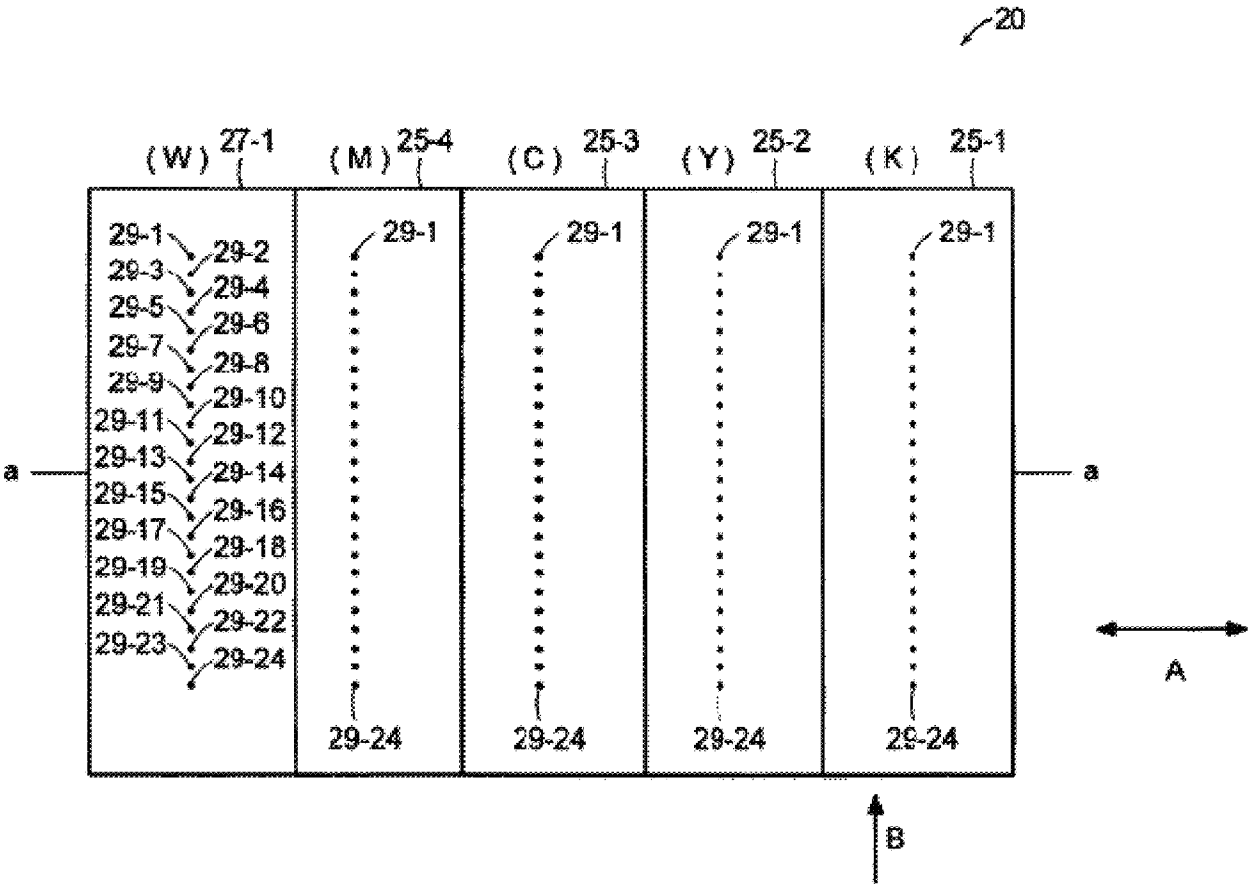
FIG. 3 is a block diagram depicting the underside of a print head carriage of FIG. 2, consistent with various embodiments.

FIG. 3 is a block diagram depicting the underside of a print head carriage of FIG. 2, consistent with various embodiments. Each of the print heads 25-1, 25-2, 25-3, 25-4, 27-1 includes a row of nozzles 29 running along the length of the print head. A typical print head may include a row of 256 uniformly-spaced nozzles, with a spacing of about 4/360 of an inch between adjacent nozzles. Typically, a printing system will include a set of print heads for depositing ink of each color, with each print head in the set slightly offset from the others to increase the printing system resolution. (For instance, in a system using four print heads per ink color, an offset of 1/360th of an inch between each head provides a resolution of 360 dpi). For purposes of illustration, only five print heads are shown in FIG. 3, one for each different color ink (i.e., W, M, C, Y, K), and each print head includes only twenty-four nozzles, e.g., nozzles 29-1 through 29-24.

During a printing operation, the substrate 1002 moves under print heads in the direction of arrow B, as the carriage 18 holding the print heads scans across the substrate 1002 in the direction of arrow A. The controller 65 in the printing system 10 actuates the print heads to selectively eject ink droplets from some or all of the nozzles 29 to deposit printing fluids on the substrate 1002 in a pre-determined pattern. In some embodiments, the pattern is provided as part of an RTL file, which includes instructions for printing the texture and/or image in a format understandable by the printing system 10. According to the present disclosure, the controller 65 is adapted to operate the printing system 10 in a multi-channel mode where the some or all of the nozzles 29 are selectively used for ejecting ink on to the substrate 1002. The nozzles that are selected are based on the characteristics of the texture and/or the image to be printed.

Figure 4:
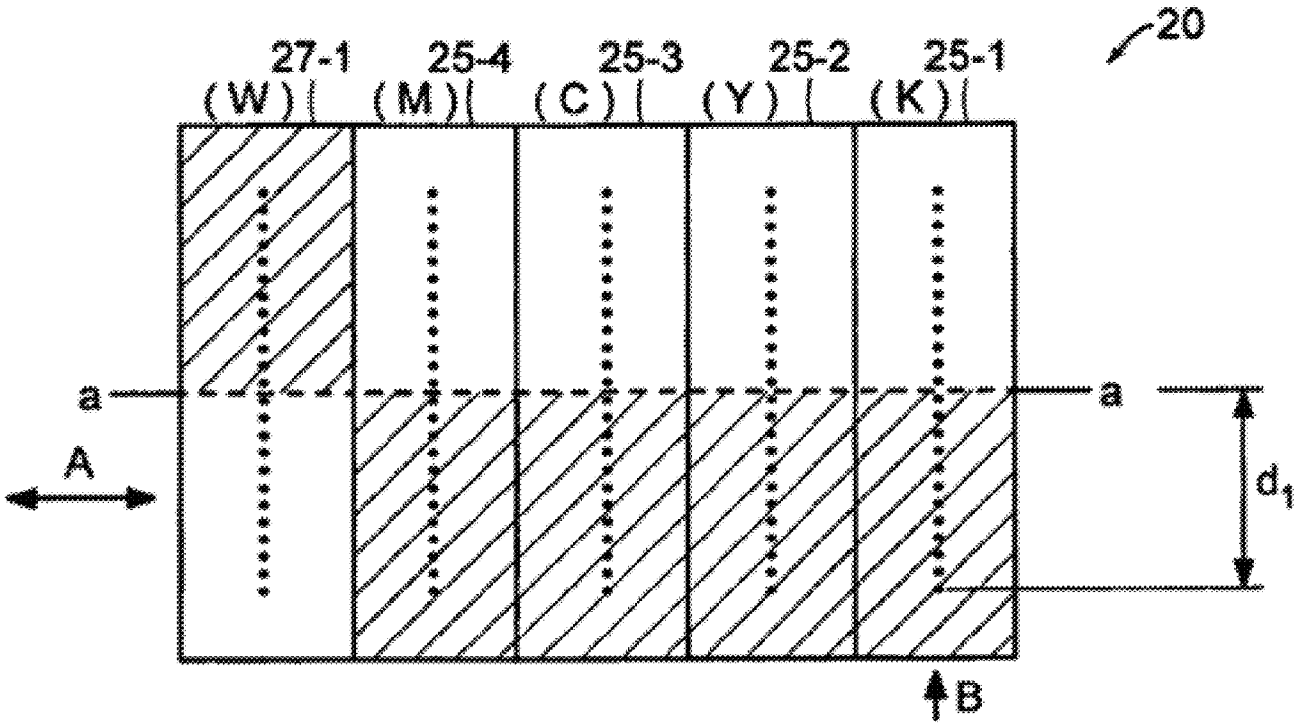
FIG. 4 is a block diagram of an underside of the print head carriage of FIG. 3 as used in a multi-channel/multi-layer mode.

FIG. 4 is a block diagram of an underside of the print head carriage of FIG. 3 as used in a multi-channel/multi-layer mode. In the example of FIG. 4, the multi-layer mode is dual-layer, which includes printing in two layers. In some embodiments, multi-layer means number of layers of ink printed on the substrate 1002 for a given pixel of the textured image. For example, for dual-layered printing in FIG. 4, two layers of ink can be printed on the substrate—a first layer of ink is printed by the leading nozzles (i.e., nozzles 29-13 through 29-24) of one or more of the print heads 20 and another layer of ink by the trailing nozzles (i.e., nozzles 29-1 through 29-12) of one or more of the print heads 20. In some embodiments, the trailing nozzles deposit the ink after the substrate 1002 is incremented by a distance $d_1$ (where $d_1$ is a length of a section of the nozzles, e.g., nozzles 29-13 through 29-24).

In this mode, as the carriage 18 scans across the substrate along the direction of arrow A, the controller 65 causes ink to eject from the nozzles of the non-hatched regions of colored ink print heads 25-1, 25-2, 25-3 and 25-4, and white ink print head 27, but no ink is ejected from the hatched regions of these heads. Accordingly, as the substrate moves along the direction of arrow B, it will first receive a layer of substantially white ink from the leading half of the nozzles of print head 27. Then, as the carriage 18 scans back across the substrate 1002 and the substrate 1002 is incremented by a distance $d_1$ along direction of arrow B, the trailing nozzles of color ink print heads 25-1 through 25-4 print a color image over the layer of substantially white ink, while the leading nozzles of print head 27 deposit a layer of substantially white ink on the next section of the substrate 1002 to pass under the heads. This process is repeated until the entire textured image is printed, e.g., for all pixels in the entire substrate 1002. In some embodiments, the color of the ink that should be deposited on the substrate, the nozzles that have to eject the ink are determined by the instructions in the RTL file of the textured image, which are generated based on the actual textured image.

It will be understood that, if necessary, a radiation source may be arranged to partially or fully cure each region of white ink and/or each region of colored inks, as they are deposited. Accordingly, the printing system 10 may simultaneously deposit both a pre-coat layer, and a color image layer on top of a pre-coat layer, using a single print head array 20 arranged along a single axis "a-a." Note that although the above example illustrates printing one layer of white ink and another layer of colored ink over the white ink, the order of depositing the inks is not restricted to the above. The printing system 10 can be configured to print the layers in any order. In some embodiments, the RTL file of the textured image determines which colors are printed in which layer.

A person of ordinary skill in the art will understand that although the embodiment of FIG. 4 shows half of the nozzles of print head 27 as performing the printing in one layer, and another half of the nozzles printing in the second layer, this exact percentage is not necessary.

The example of FIG. 4 illustrates dual-layered printing. The printing system 10 can be configured to print more than two layers, e.g., three layers as described in FIG. 5, five layers as described with reference to FIG. 8, etc. The higher the number of layers, the taller the texture of the printed image. In some embodiments, to achieve multi-layered printing of a particular layer count, the nozzles of print heads 20 are segmented into as many sections as the particular count. For example, to print a three layered textured image, the nozzles of the print heads 20 are segmented into three sections, as illustrated in FIG. 5.

Figure 5:
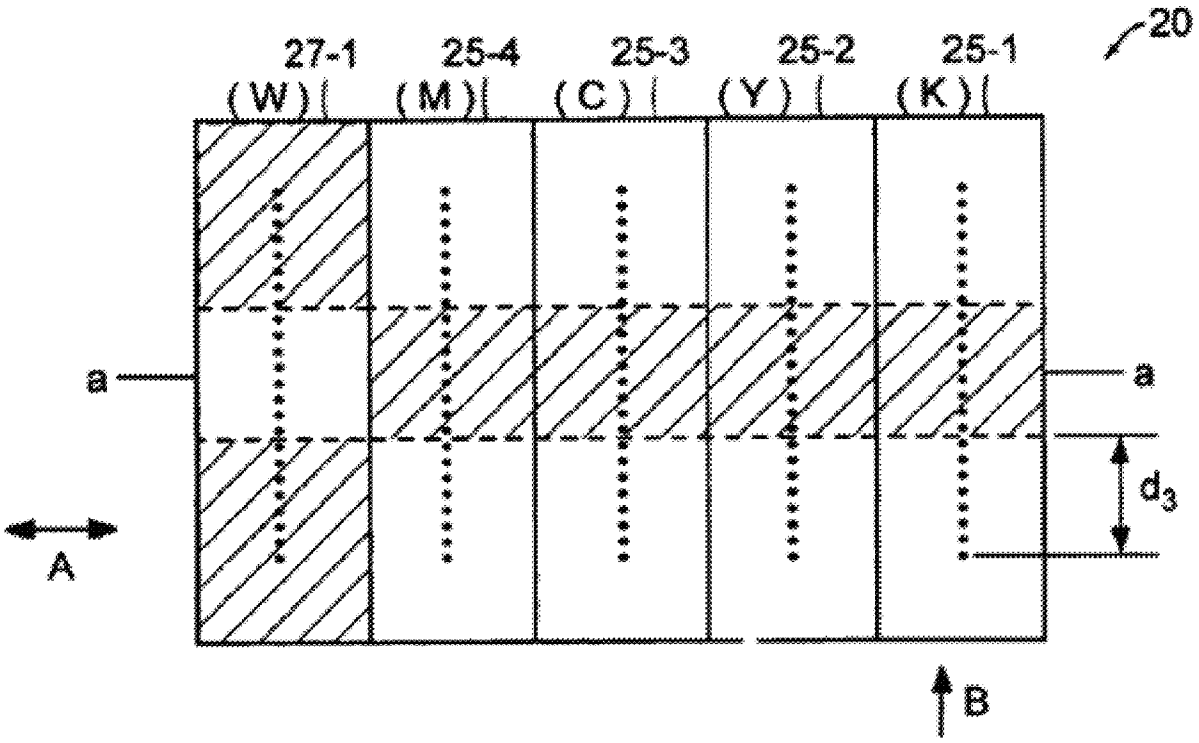
FIG. 5 is a block diagram of the underside of the print head carriage of FIG. 3 as used in printing in a three-layered multi-layer mode, consistent with various embodiments.

FIG. 5 is a block diagram of the underside of the print head carriage of FIG. 3 as used in printing in a three-layered multi-layer mode, consistent with various embodiments. In this mode of operation, as carriage 18 scans across the substrate 1002 along the direction of arrow A, the controller 65 causes colored ink to eject from the nozzles of the non-hatched regions of color ink print heads 25-1, 25-2, 25-3 and 25-4, and a specialized printing fluid from print head 27, but no ink is ejected from the hatched regions of these heads. The nozzles of the print heads are segmented into three sections, e.g., the leading section (i.e., nozzles 29-17 through 29-24), the middle section (i.e., nozzles 29-9 through 29-16) and the trailing section (i.e., nozzles 29-1 through 29-8). Different sections eject ink in different layers.

For example, in a three layered textured printing of a textured image, a first layer can be the texture, a second layer can be a substantially white ink and the third layer can be the image. As the substrate 1002 moves under the carriage 18, some or all of the color ink print heads 25 eject ink from the leading section of the nozzles forming the textured layer, then as the substrate 1002 is moved in the direction of arrow B by distance $d_3$, where $d_3$ is a length of each section of the nozzles, the white print head deposits a second layer of white ink on the textured layer, then as the substrate 1002 is moved again by distance $d_3$, some or all of the color ink print heads 25 eject ink from the trailing section of the nozzles forming the image layer.

This process is repeated until the entire textured image is printed, e.g., for all pixels in the entire substrate 1002. In some embodiments, the color of the ink that should be deposited on the substrate, the nozzles that have to eject the ink in a particular layer are determined by the instructions in the RTL file of the textured image, which are generated based on the actual textured image.

Figure 6:
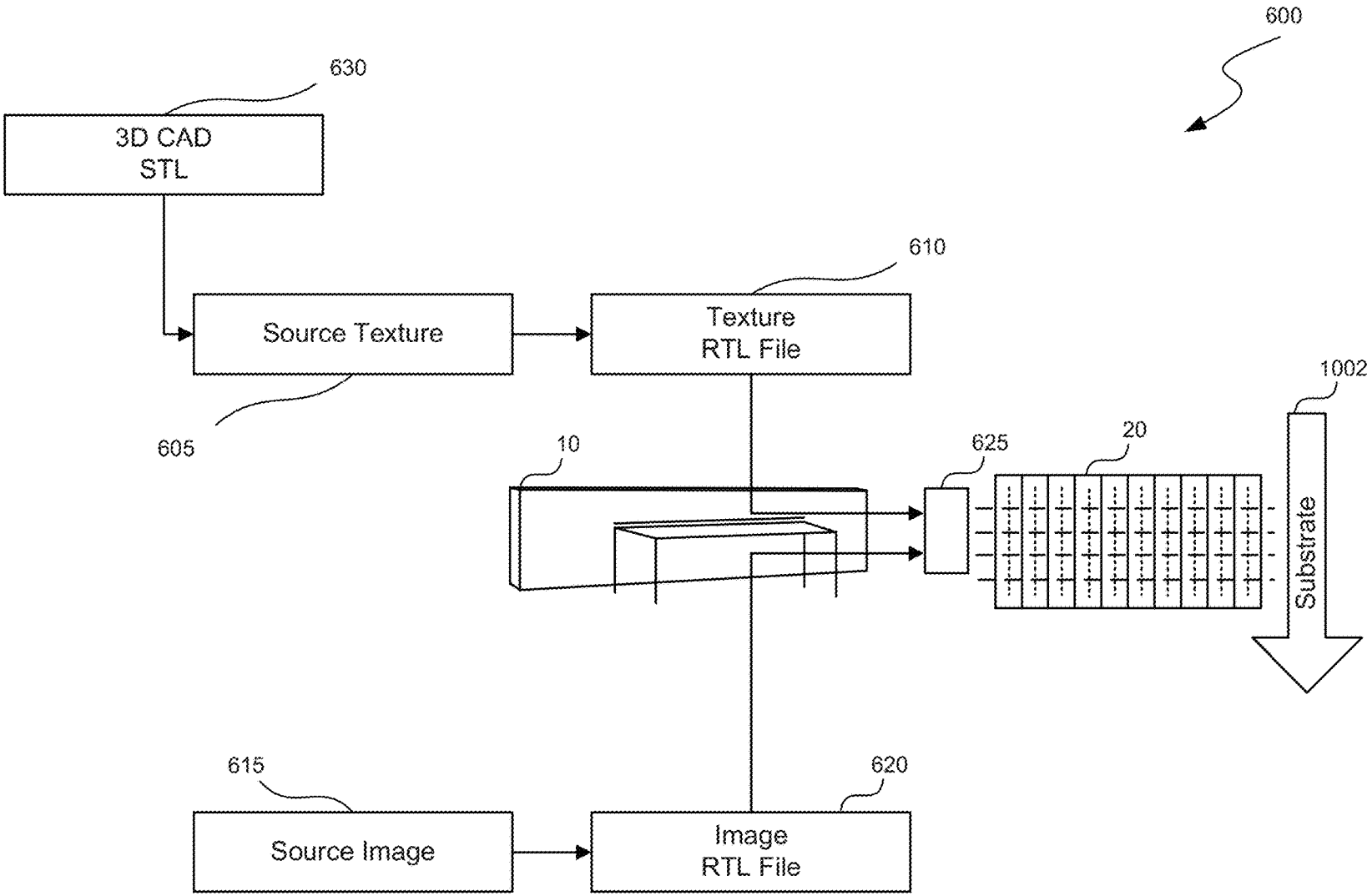
FIG. 6 is a block diagram illustrating printing of a multi-layered textured image using the printing system of FIG. 1, consistent with various embodiments.

FIG. 6 is a block diagram illustrating printing of a multi-layered textured image using the printing system of FIG. 1, consistent with various embodiments. The example 600 illustrates printing of a multi-layered textured image for an image represented by a source image file 615 using the texture specified in a source texture file 605. The user may specify the source image file 615 and the source texture file 605 using the printing application 55. The printing application 55 includes a GUI, such as the GUI 1100 of FIG. 11 described below, for receiving the source image file 615 and the source texture file 605. As described above, the printing application 55 can execute in any of the printing system 10 or computer connected to the printing system 10 that coordinates the printing of the textured image.

The source texture file 605 and the source image file 615 can be in a variety of formats, e.g., BMP, GIF, JPEG, TIFF, and PNG. In some embodiments, the texture can also be input to the printing application 55 as a 3D computer aided design (CAD) style file, which is then converted to the source texture file 605 of one of the above formats. The printing application 55 converts the source texture file 605 and the source image file 615 into a format understandable by the printing system, e.g., RTL format, to generate a texture RTL file 610 and an image RTL file 620, respectively. The printing application 55 further processes the texture RTL file 610 and an image RTL file 620 to generate a combined RTL file 625 that represents the textured image, which has multiple layers. The printing system 10 then prints the textured image on the substrate 1002 based on the combined RTL file 625. The combined RTL file 625, which is described in detail in the following paragraphs, can include information regarding the number of texture layers, the colors of the ink that has to be deposited in each of the texture layers, the number of white layers, the number of image layers, the order of all the layers, etc., for each pixel of the textured image.

In some embodiments, the source texture file 605 is a black and white or grayscale image file having intensity information, e.g., as values between 0-255, of each of the pixels of the texture. In some embodiments, the higher the intensity, the thicker or taller the texture at that particular pixel. The printing application 55 converts the source texture file 605 to the texture RTL file 610 having an ink droplet count that determines the thickness of the texture each pixel should have, and therefore the number of layers of the texture. The image RTL file 620 specifies information regarding the number of layers of the image to be printed.

Figure 7:
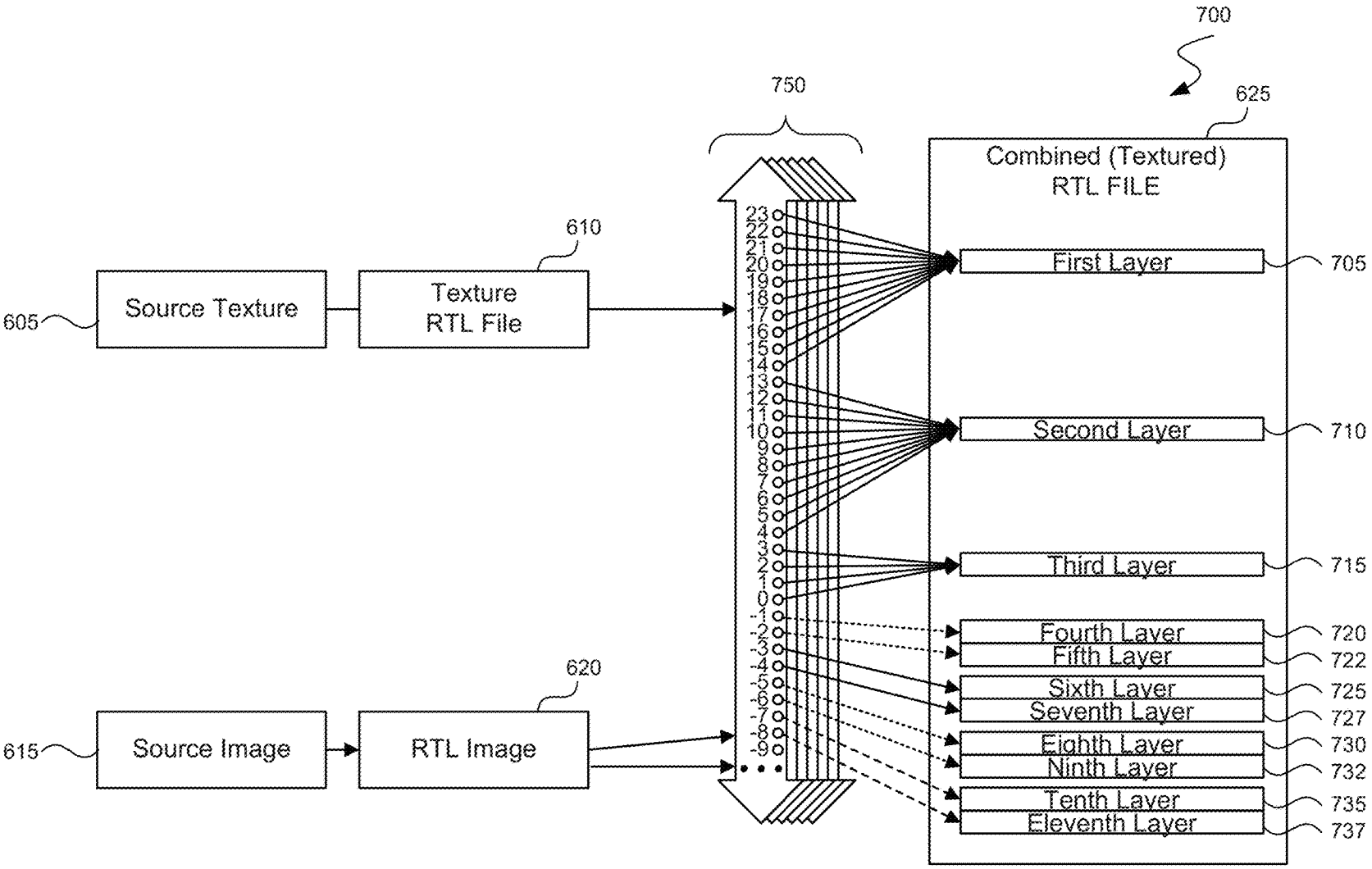
FIG. 7 is a block diagram illustrating an example of the combined RTL file 625 of FIG. 6 representing the textured image to be printed, consistent with various embodiments.

FIG. 7 is a block diagram illustrating an example of the combined RTL file 625 of FIG. 6 representing the textured image to be printed, consistent with various embodiments. The RTL files 610, 620 and 625 are generated as a function of one or more of the number of color print heads the printing system 10 has, intensity of the texture in the source texture file 605, a desired ink droplet count for the texture and/or the image, which determines the thickness of the texture and/or the image to be printed, a number of white layers, a number of blank layers, etc. Some or all of the above values can either be specified by a user, e.g., in the GUI of the printing application, or set to default values. Further, in some embodiments, for the thickness of the texture, the user may specify the thickness in other dimensions, e.g., inch, centimeter, and the printing system can convert that into the ink droplet count, which can be based on the thickness of the ink used in the print heads.

For example, consider that the printing system 10 has "10" print heads; two print heads for each of W, K, Y, M, and C, color. The desired ink droplet count, that is, the maximum thickness for the texture is set to "23," the number of white layers and blank layers are each set to "2" and the number of layers for the image is also set to "2."

The printing system determines an ink droplet for a given pixel of the texture represented by the source texture file 605 as a function of the intensity of the given pixel and the desired maximum ink droplet count. The printing system obtains the intensity information of each of the pixels in the source texture file 605, e.g., which can be in the range of 0-255 with 255 being the darkest intensity. If the intensity value of a first pixel is 255, then the texture at that first pixel is thickest, that is, the first pixel would have an ink droplet count set to the desired maximum ink droplet count "23." The lower the intensity for a given pixel, the lower the droplet counts for the given pixel. The droplet count of "23" translates to "3" layers of texture; the printing system 10 has "10" print heads and therefore, can deposit a maximum of "10" droplets of ink for a given pixel in a single layer. So the printing system 10 prints three layers for the texture, a first layer 705 in which "10" droplets of ink are deposited, a second layer 710 in which another "10" droplets are deposited, and a third layer 715 in which the remaining "3" droplets are deposited. The colors of ink deposited in the third layer 715 for the "3" droplets can be chosen randomly, or based on user specified criteria. Accordingly, the texture RTL file 625 would have three texture layers 705-715 for the first pixel.

With reference to the image RTL file 620, as the number of layers for the image is set to "2," the image RTL file 620 would be split to two layers—a tenth layer 735 and eleventh layer 737.

The printing application 55 processes the texture RTL file 610 and the image RTL file 620 to generate the combined RTL file 625. In addition to the texture layers 705-715 and image layers 735-737, the combined RTL file 625 includes the white layers 725 and 727, and the blank layers 720-722 and 730-732. The combined RTL file 625 also includes information regarding the order of the layers 705-737, and also other instructions for printing the textured image, e.g., which section of the nozzles of the print heads should deposit ink in which layer. In some embodiments, the above process of determining the layers is repeated for all the pixels of the source image file 615 and the source texture file 605.

The printing application 55 generates a count array 750 for each of the pixels in the textured image. The count array 750 includes the ink droplet count for each of the pixels, which is determined as described above. For example, the count array 750 for the first pixel includes a counter which is set to the value of the ink droplet count "23" of the first pixel. As and when the printing system 10 deposits a droplet of ink for the first pixel on the substrate 1002, the counter is decremented by a specified value, e.g., "1", for the first pixel. In some embodiments, depositing of a droplet of ink by a print head is considered as one count. The droplet may be deposited using one or more nozzles of the print head. When the counter of the count array 750 drops below zero, the controller 65 of the printing system 10 is notified of the completion of printing the texture layers for the first pixel. The controller 65 then prepares for printing the next type of layers for the first pixel, e.g., blank layers 720 and 722, which can involve instructing the print heads not to print anything, and when the counter drops by two further counts indicating completion of blank layers, the controller 65 instructs the print heads of white ink to print two layers of white, and so on until the first pixel is printed completely.

The count array 750 helps in determining when the layer switch should be performed, e.g., from one layer to another layer such as from the first texture layer 705 to the second texture layer 710, or from one type of layer to another type of layer such as from the texture layer to the blank layer, so that the controller 65 can instruct the print heads to deposit ink accordingly.

Further, the count array 750 also helps the controller 65 of the printing system 10 in determining which print heads have to deposit ink on the substrate 1002 in which layer and which nozzles of the print head have to deposit ink. For example, for the third texture layer 715, the counter would have a value of "3," which indicates the controller 65 to command only three print heads to deposit ink.

The printing application 55 inserts one or more layers of white ink between the texture and the image in order to provide a bright background for the image to be printed on the texture. Further, the printing application 55 also inserts one or more blank layers or spacers between the texture and the white layers and between the white and the image layers, e.g., to provide uniformity of the image and to minimize the spatter caused due to overspray of ink to a neighboring pixel. For example, if a white layer is immediately printed next to the texture layer on a given pixel, the pixel next to the given pixel, which is still a texture pixel can spatter onto the white and make the white less effective. By inserting one or more blank layers between different types of layers, e.g., between the white and the texture, the spatter is minimized. Further, curing techniques, such as curing using radiation sources 28 are used to cure the ink deposited on the substrate 1002.

The combined RTL file 625 can also include information as the number of layers to be printed in a single pass of the substrate 1002. In some embodiments, a pass is defined as a number of times the substrate 1002 is input to the printing system 10 to print a particular image. For example, in a two pass print, when the substrate 1002 passes under the print heads for the first time a portion of the image is printed, and when the substrate 1002 passes under the print heads for the second time, the remaining portion of the image is printed. For the second pass, the substrate 1002 is fed into the printing system 10 again. While the substrate can be fed in again, in some embodiments, the printing system 10 may not release its hold on the substrate 1002. The printing system 10 can print one or more layers in each pass of the substrate 1002. For example, in FIG. 8, the printing system 10 is configured to print five layers in some passes and in two layers in some passes.

Figure 8:
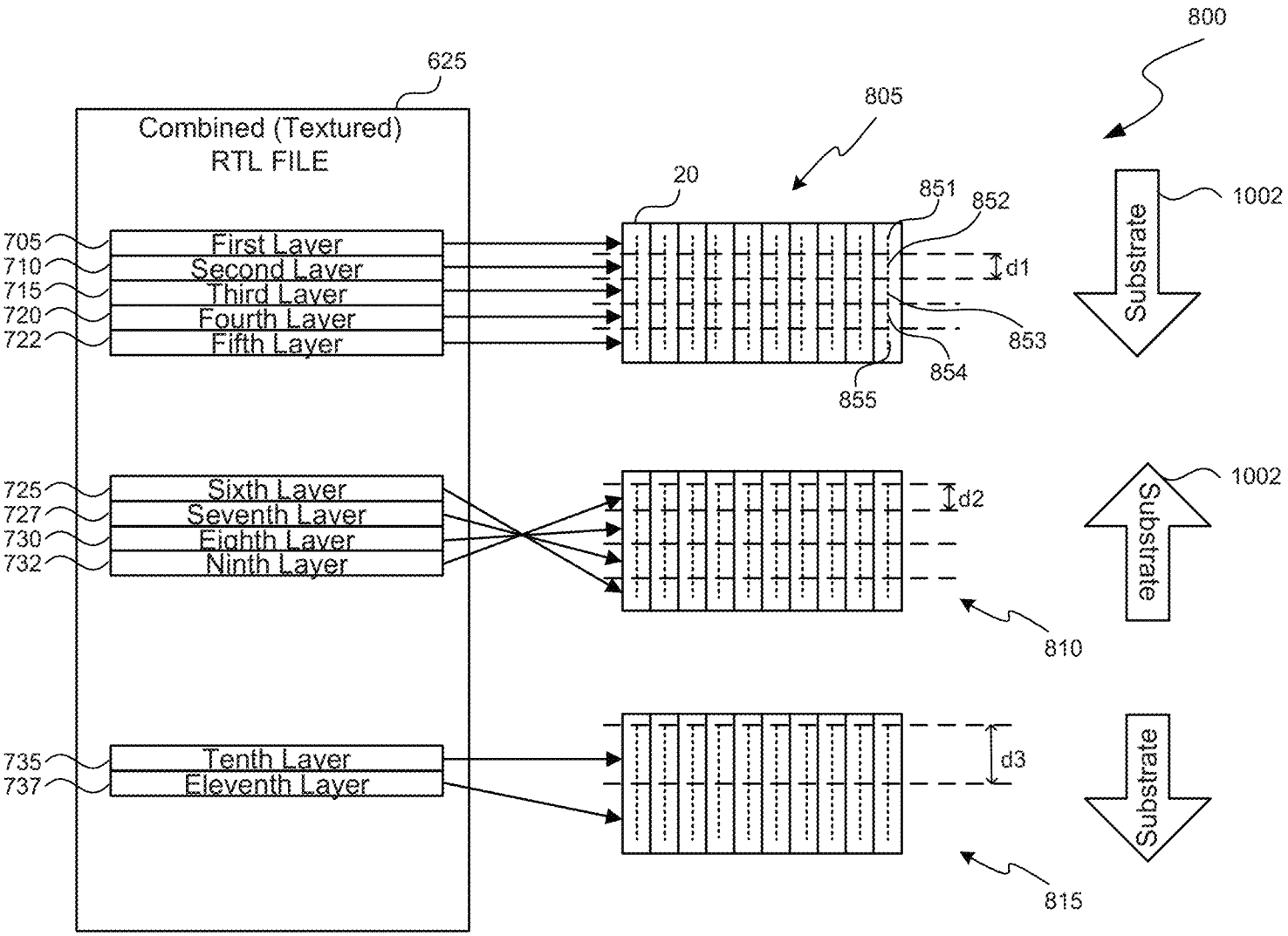
FIG. 8 is a block diagram illustrating a multi-layer and multi-pass printing of the textured image, consistent with various embodiments.

FIG. 8 is a block diagram illustrating a multi-layer and multi-pass printing of the textured image, consistent with various embodiments. The printing system 10 can be configured to print in different number and/or the same number of layers in different passes of the substrate. In the example 800, the printing system 10 is configured to print in five layers in first pass 805, four layers in second pass 810 and in two layers in third pass 815. For example, the printing system 10 prints the layers from the first layer 705 to the fifth layer 722 in the first pass 805, the sixth layer 725 to ninth layer 732 in the second pass and the image layers 735 and 737 in two layers In some embodiments, if the height of the texture is higher than a specified threshold, the printing carriage 18 of the printing system 10 may have to be raised before the layer is printed otherwise the print head may touch the texture. For example, if a topographic map is being printed, the mountains may get taller and the print head may touch the mountain, which obstructs the movement of the carriage and causes problem in printing. Accordingly, the carriage can be raised so that the printing system is able to continue printing the mountain. But if the carriage is raised, the other portions of the topographic map, e.g., lower surfaces may be far from the print head and the ink may not be deposited accurately when the print head sprays the ink on the lower surfaces. Accordingly, to avoid the above problem, the printing system 10 prints the lower portions of the images before the carriage 18 is raised, and when the carriage 18 is raised in the next pass, the higher portions of the textured image is printed. Thus, in some embodiments, multi-pass printing may be used to print the textured images effectively.

In some embodiments, the number of layers to be printed in a single pass is determined as a function of the thickness of the ink deposited and a print gap, e.g., a dimension of a gap between the print heads and the substrate 1002. The thicker the ink is, the lesser the number of layers that can be printed in the single pass of the substrate under the print heads. Further, to achieve multi-layer printing, the nozzles of the print heads may be logically segmented in to a number of sections, as described at least with reference to FIGS. 4 and 5. For example, to print the five layers 705-722 in the first pass 805, the controller 65 segments the nozzles of the print head 20 into five sections—a first section 851, a second section 852, a third section 853, a fourth section 854 and a fifth section 855.

Different sections of nozzles deposit ink in different layers. For example, when the substrate 1002 moves under the print heads in the direction of the arrow, the nozzles of one or more of the print heads in the first section 851 deposit ink on the substrate 1002, then the substrate 1002 is moved by distance $d_1$ in the direction of the arrow, the nozzles of one or more of the print heads in the second section 852 deposit ink on the portion of the substrate 1002 on which the first section 851 has deposited ink, and the first section 851 deposits ink on a new portion of the substrate 1002 that comes under the print heads when the substrate 1002 was moved by distance $d_1$. The distance $d_1$ is a length of a section of the nozzles in the first pass 805, which is determined as a function of the number of layers to be printed in a given pass. The process of printing and moving the substrate 1002 by $d_1$ continues for all the remaining of the five layers of the first pixel of the textured image, and at the end of the first pass 805, a portion of the substrate 1002 corresponding to the first pixel can have five layers of ink on it. The above process is performed for all the pixels the textured image.

Note that different pixels of the textured image can have different number of layers and therefore, different portions of the substrate 1002 can have different number of layers of ink at the end of first pass 805.

After the first pass 805, the carriage 18 can be raised to print the next set of layers 725-732 in the second pass 810. Note that the printing system 10 is configured to print the textured image in four layers in the second pass 810. Further, note that, as indicated by the direction of the arrow, the substrate 1002 is moving in a direction reverse to the direction it moved in the first pass 805. In some embodiments, this minimizes the time otherwise consumed for placing the substrate 1002 in its initial position, e.g., the position at which it started in the first pass 805, to start printing in the second pass 810. Since the substrate is moving in the reverse direction, the layers 725-732 are also printed in the reverse direction. In some embodiments, the direction of movement of the substrate 1002 is the same in alternate passes. Since only four layers are printed in the second pass 810, the nozzles are segmented into four sections, and the substrate 1002 is also moved by a distance, $d_2$, equivalent to the length of a section of the nozzles in the second pass 810, to print the layers successively. The process of printing and moving the substrate 1002 by $d_2$ continues for all the layers of the first pixel of the textured image, and at the end of the second pass 810, a portion of the substrate 1002 corresponding to the first pixel can have four layers of ink on it in addition to the five layers of ink printed in the first pass 805.

Note that different pixels of the textured image can have different number of layers and therefore, different portions of the substrate 1002 can have different number of layers of ink at the end of second pass 810.

In the third pass 815, the two image layers 735 and 737 are printed in two layer configuration. In some embodiments, the controller 65 prints the image layers in a separate pass and with as minimum layers as possible, e.g., in order to save time. Although the example 800 illustrates printing the image layers in a separate pass, the printing system is not restricted to printing the image layers in a separate pass. The image layers can be group with other layers in other passes.

Further, note that, as indicated by the direction of the arrow, the substrate 1002 is moving in a direction reverse to the direction it moved in the second pass 810, and in the same direction as the first pass 805. Since only two layers are printed in the third pass 815, the nozzles are segmented into two sections, and the substrate 1002 is also moved by a distance, $d_3$, equivalent to the length of a section of the nozzles in the third pass 815, to print the layers successively. The process of printing and moving the substrate 1002 by $d_3$ continues for both the layers of the first pixel of the textured image, and at the end of the third pass 815, a portion of the substrate 1002 corresponding to the first pixel can have two layers of ink on it in addition to the nine layers of ink printed in the first pass 805 and the second pass 810.

Note that different pixels of the textured image can have different number of layers and therefore, different portions of the substrate 1002 can have different number of layers of ink at the end of third pass 815. Further, if other pixels of the textured image have more layers than the first pixel, the printing may take more number of passes than depicted in example 800.

In some embodiments, the combined RTL file 625 stores each of the layers as a separate job. The job includes multiple attributes that describe and/identify the job. For example the job includes a name attribute which stores the name of the job such as "Texture" "Blank" "White," etc. and a layer attribute to indicate the layer number. In some embodiments, the name is the same for all layers, indicating that they print into the same image. A different name can indicate a different image, this is how the printing system 10 can identify all the sub-job layers that belong to the same job within the RTL that can contain multiple jobs. When the combined RTL file 625 is input to the printing system 10, the controller 65 of the printing system 10 co-ordinates the working of the carriage 18, the movement of the substrate 1002, selecting a set of print heads to deposit the ink in a particular layer, selecting the set of nozzles to deposit the ink in a particular layer etc.

Figure 9:
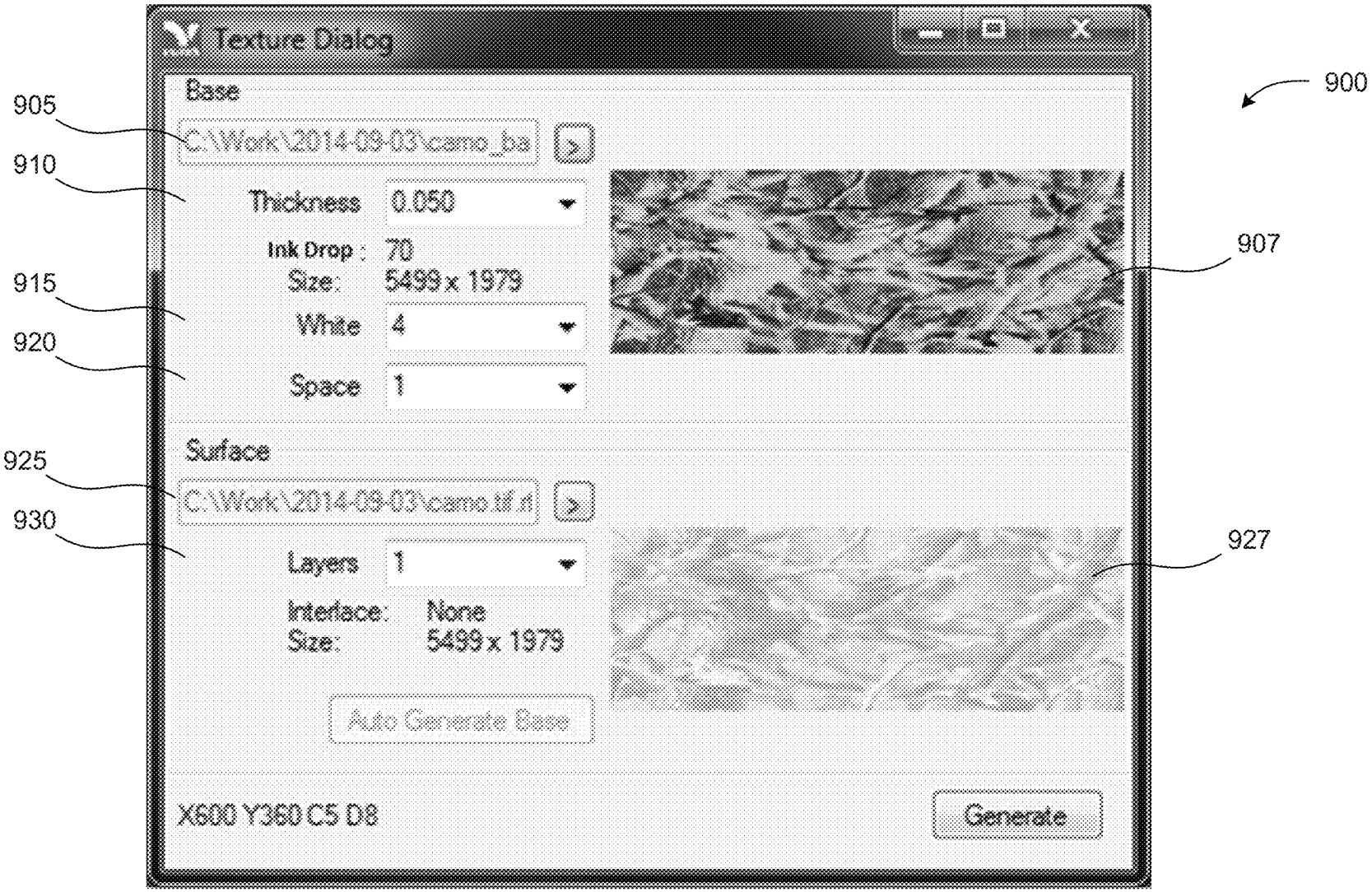
FIG. 9 is an example of a GUI of a printing application of FIG. 1B for generating a print job to print a multi-layered textured image, consistent with various embodiments.

FIG. 9 is an example of a GUI of a printing application of FIG. 1B for generating a print job to print a multi-layered textured image, consistent with various embodiments. The printing application 55 includes a GUI 900 that allows a user to generate a print job for printing a multi-layered texture image. The user can specify the texture 907 of an image 927 by inputting a texture file representing the texture 907 using a first input field 905. In some embodiments, the texture file is similar to the source texture file 605 of FIG. 6. The user can also specify the thickness of the texture using a second input field 910. The thickness can be specified in a number of dimensions, e.g., millimeter, centimeter, and inch. In some embodiments, the thickness specified is the maximum thickness of the texture. The thickness of the texture at different pixels can be different, and is a function of the intensity information of a given pixel in the texture file.

The printing application 55 determines a number of ink drops required to achieve the thickness specified in the second input field 910. In some embodiments, the number of ink drops required to achieve a particular thickness depends on the thickness of the ink used in the printing system 10.

The GUI 900 allows the user to specify the number of layers of white ink to be deposited in the textured image, e.g., as described at least with reference to FIGS. 6 and 7, using a third input field 915. In some embodiments, the printing application 55 can have a default value set for the number of white layers. The user can further customize this by inputting a different value.

The GUI 900 allows the user to specify the number of blank layers to be deposited in the textured image, e.g., as described at least with reference to FIGS. 6 and 7, using a fourth input field 920. In some embodiments, the printing application 55 can have a default value set for the number of blank layers. The user can further customize this by inputting a different value in the fourth input field 920.

The GUI 900 includes a fifth input field 925 using which the user can specify an image file representing the image 927 to be printed as multi-layered textured image. In some embodiments, the image file is similar to the source image file 615 of FIG. 6. The GUI 900 includes a sixth input field 930 using which the user can specify a number of layers in which the image 927 has to be printed.

The printing application 55 allows the user to generate print job, e.g., print job 60, using the GUI element such as the button "Generate" in the GUI 900. In some embodiments, generating the print job includes processing the texture to generate a printer executable file, e.g., texture RTL file 610, processing the image to generate a printer executable file, e.g., image RTL file 620, and processing the texture RTL file and the image RTL file to generate a combined RTL file 625 including instructions for printing the image as multi-layered textured image, as described at least with reference to FIGS. 6 and 7.

Figure 10:
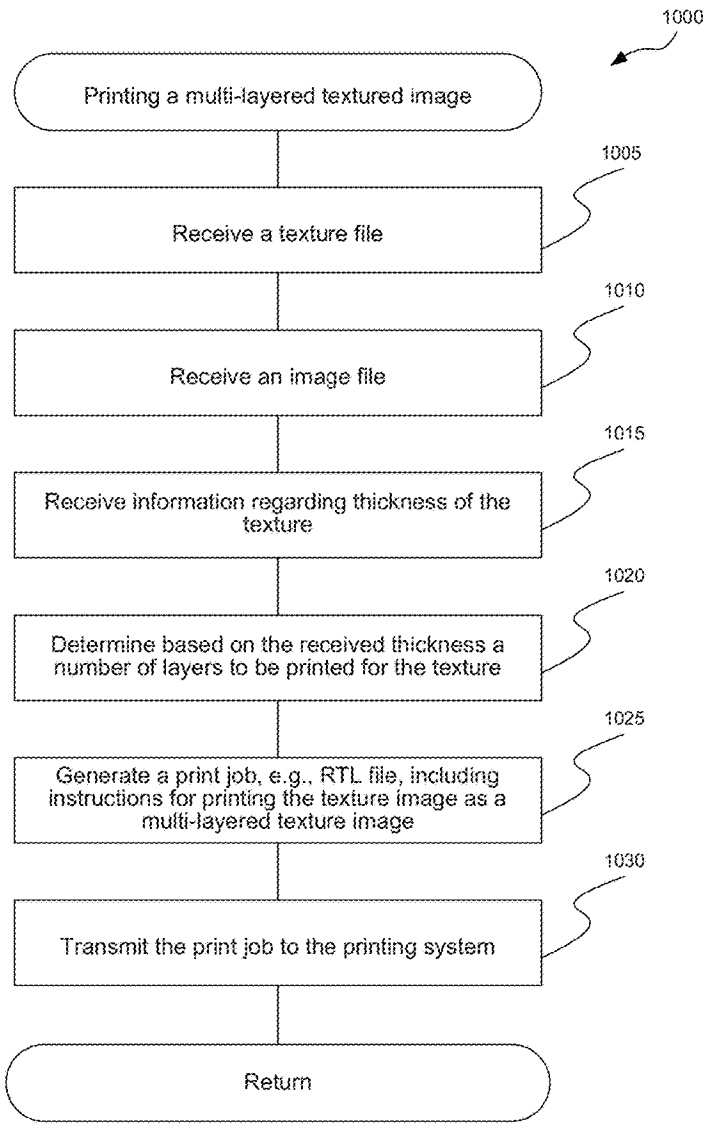
FIG. 10 is a flow diagram illustrating a process printing a multi-layered textured image, consistent with various embodiments.

FIG. 10 is a flow diagram illustrating a process 1000 printing a multi-layered textured image, consistent with various embodiments. The process 1000 may be executed in the environment 100 of FIG. 1B. At block 1005, the printing application 55 of the computing device 50 receives a texture file that represents a texture using which an image has to be printed. In some embodiments, the texture file can be input using the GUI 900 of FIG. 9.

At block 1010, the printing application 55 receives an image file representing the image to be printed as the multi-layered textured image. In some embodiments, the image file can be input using the GUI 900.

At block 1015, the printing application 55 receives information regarding the thickness of the texture. In some embodiments, the thickness of the texture can be input using the GUI 900.

At block 1020, the printing application 55 determines the number of layers of the texture based on the received thickness. At block 1025, the printing application 55 generates a print job, e.g., in RTL file format, that includes instructions for printing the image as a multi-layered textured image. At block 1030, the printing application transmits the print job to the printing system 10, which prints the image as a multi-layered textured image on a substrate such as substrate 1002, e.g., as described at least with reference to FIGS. 6-8.

Figure 11:
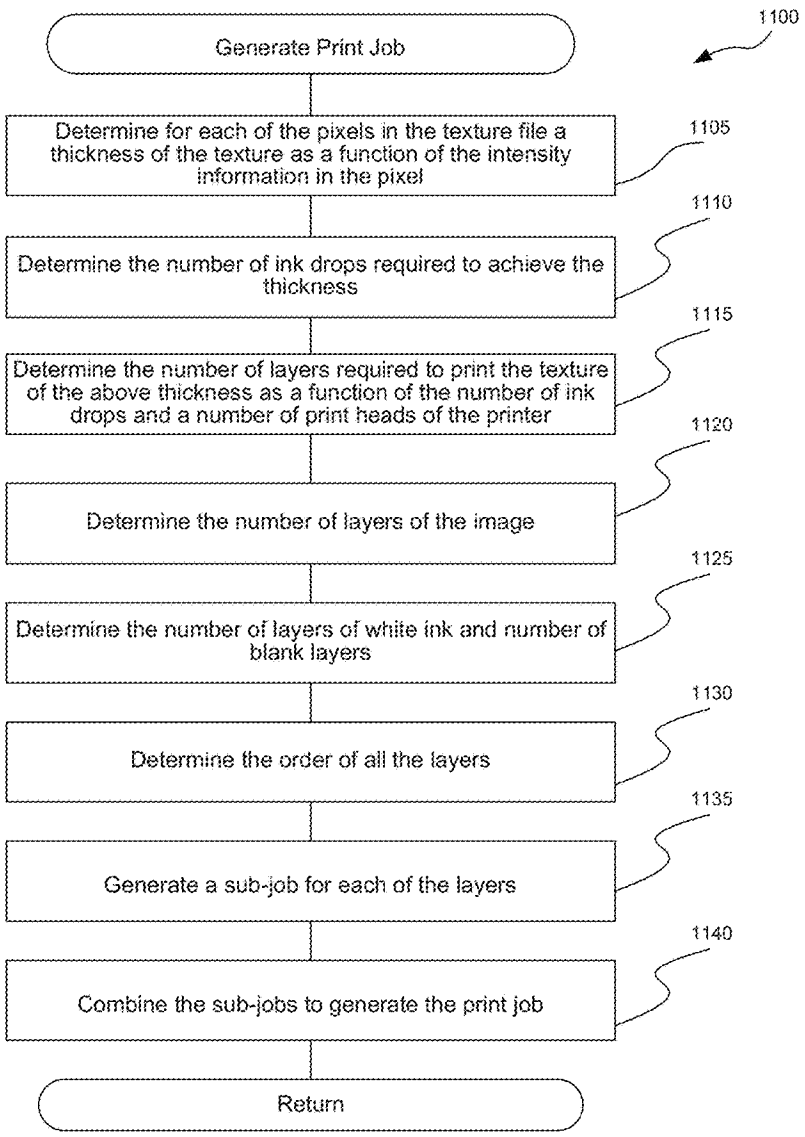
FIG. 11 is a flow diagram of a process for generating a print job in RTL format to print a multi-layered textured image, consistent with various embodiments.

FIG. 11 is a flow diagram of a process 1100 for generating a print job in RTL format to print a multi-layered textured image, consistent with various embodiments. The process 1100 may be executed in the environment 100 of FIG. 1. In some embodiments, the process 1100 describes the step 1025 of generating the print job of FIG. 10. At block 1105, the printing application 55 determines for each of the pixels in the texture file the thickness of the texture to be printed on the substrate. In some embodiments, the thickness is determined as a function of the intensity information of the given pixel, e.g., as described with reference to FIG. 7. For example, if the maximum thickness (e.g., the thickness specified in the GUI 900) is one inch for a pixel with the highest intensity, then the thickness of the texture at a given pixel with 50% intensity is a determined as a 50% of maximum thickness, e.g., half inch.

At block 1110, the printing application determines the thickness of the texture for each of the pixels in terms of number of ink drops required to achieve the thickness on the substrate, e.g., as described with reference to FIG. 7.

At block 1115, the printing application determines the number of layers of the texture to be printed on the substrate for each of the pixels as a function of the number of ink drops and a number of print heads of the printing system that deposits ink on the substrate, e.g., as described with reference to FIG. 7. For example, if the number of ink drops required to achieve a particular thickness is "23" and the number of print heads that deposit ink in the printing system 10 is "10," then the number of layers of the texture to be printed on the substrate is "3" (e.g., 10 print heads*1 ink drop in one layer=10 ink drops; 2 layers*10 drops each layer=20 drops; 3rd layer=3 drops—only three print heads would deposit an ink drop in the third layer).

At block 1120, the printing application determines the number of layers of image to be printed on the substrate. In some embodiments, the number of layers of the image is specified using the GUI 900.

At block 1125, the printing application determines the number of layers of white ink and the number of blank layers to be printed on the substrate. In some embodiments, the number of layers of white ink and the number of blank layers are specified using the GUI 900.

At block 1130, the printing application determines the order of all layers, including layers of the texture, layers of the image, layers of white ink and the blank layers.

At block 1135, the printing application generates a sub-job for each of the layers. The sub-job includes multiple attributes that identify the sub-job. For example, a sub-job includes a first attribute that identifies which print job it belongs to. The sub-job can also include a second attribute that identifies a number of the layer among all the layers.

At block 1140, the sub-jobs are combined into a print job. The print job is generated in a printer executable format, e.g., RTL format.

Figure 12:
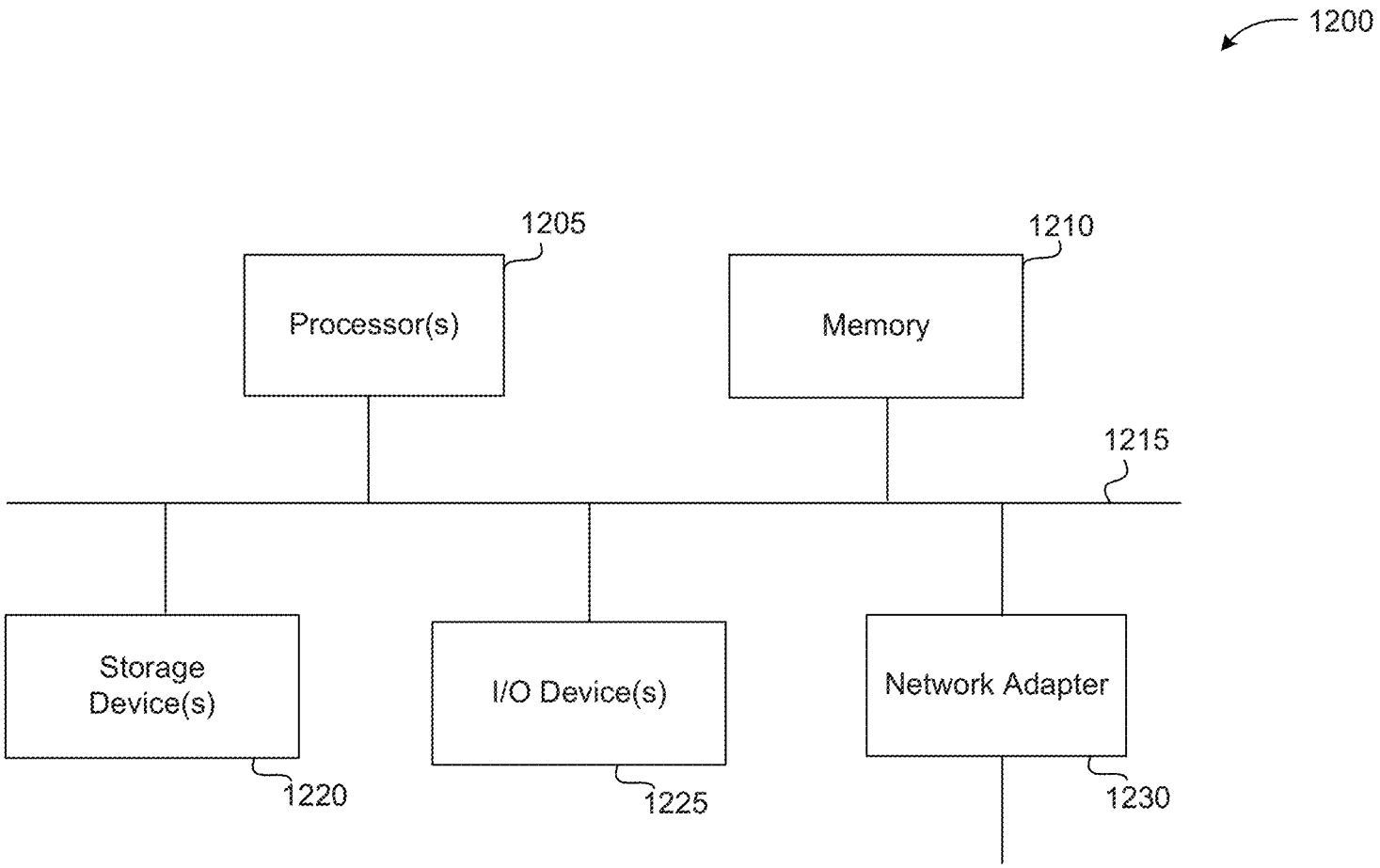
FIG. 12 is a block diagram of a computer system as may be used to implement features of some embodiments of the disclosed technology.

FIG. 12 is a block diagram of a computer system as may be used to implement features of some embodiments of the disclosed technology. The computing system 1200 may be used to implement any of the entities, components or services depicted in the examples of FIGS. 1-10 (and any other components described in this specification). The computing system 1200 may include one or more central processing units ("processors") 1205, memory 1210, input/output devices 1225 (e.g., keyboard and pointing devices, display devices), storage devices 1220 (e.g., disk drives), and network adapters 1230 (e.g., network interfaces) that are connected to an interconnect 1215. The interconnect 1215 is illustrated as an abstraction that represents any one or more separate physical buses, point to point connections, or both connected by appropriate bridges, adapters, or controllers. The interconnect 1215, therefore, may include, for example, a system bus, a Peripheral Component Interconnect (PCI) bus or PCI-Express bus, a HyperTransport or industry standard architecture (ISA) bus, a small computer system interface (SCSI) bus, a universal serial bus (USB), IIC (I2C) bus, or an Institute of Electrical and Electronics Engineers (IEEE) standard 1394 bus, also called "Firewire".

The memory 1210 and storage devices 1220 are computer-readable storage media that may store instructions that implement at least portions of the described technology. In addition, the data structures and message structures may be stored or transmitted via a data transmission medium, such as a signal on a communications link. Various communications links may be used, such as the Internet, a local area network, a wide area network, or a point-to-point dial-up connection. Thus, computer-readable media can include computer-readable storage media (e.g., "non-transitory" media) and computer-readable transmission media.

The instructions stored in memory 1210 can be implemented as software and/or firmware to program the processor(s) 1205 to carry out actions described above. In some embodiments, such software or firmware may be initially provided to the processing system 1200 by downloading it from a remote system through the computing system 1200 (e.g., via network adapter 1230).

The technology introduced herein can be implemented by, for example, programmable circuitry (e.g., one or more microprocessors) programmed with software and/or firmware, or entirely in special-purpose hardwired (non-programmable) circuitry, or in a combination of such forms. Special-purpose hardwired circuitry may be in the form of, for example, one or more ASICs, PLDs, FPGAs, etc.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

I claim:

1. A method for multi-layered textured printing based on a maximum desired droplet count, the method comprising:

receiving information regarding a number of a first plurality of layers in which an image is to be printed on a substrate by an ink jet print head based printing system in a multi-layer mode;

determining a number of a second plurality of layers of a texture of the image, the number of second plurality of layers being a function of an intensity of a given pixel of the texture and a desired maximum ink droplet count of the texture, wherein the desired maximum ink droplet count of the texture is based on a desired thickness of the given pixel of the texture; and generating a set of instructions to cause one or more print heads of the printing system to print the image with the texture as a plurality of layers on the substrate, wherein each layer of the plurality of layers has a corresponding counter to store the desired maximum ink droplet count of the texture, the set of instructions causing the printing system to perform a sequence of printing steps comprising:

executing an instruction to print the second plurality of layers of the texture on the substrate by using inks of multiple colors, wherein the second plurality of layers has a corresponding first counter which decrements, from a desired maximum ink droplet count for the second plurality of layers of the texture, a pre-determined value when the one or more print heads of the printing system deposit an ink droplet on the substrate, in response to the first counter of the desired maximum droplet count for the second plurality of layers of the texture dropping to or below zero, executing an instruction to insert a blank layer within the sequence of printing steps for the image, insertion of the blank layer within the sequence of printing steps for the image causing the printing system not to deposit any ink on the substrate for the blank layer and causing a corresponding second counter to not decrement the pre-determined value, executing an instruction to print one or more layers of white ink after the inserted blank layer, and in response to a third counter of a desired maximum droplet count for the one or more layers of white ink dropping below zero, executing an instruction to print a first plurality of color layers of the image on the one or more layers of white ink.

2. The method of claim 1, wherein generating the set of instructions includes:

executing an instruction to insert a first set of blank layers above the second plurality of layers of the texture before printing the one or more layers of substantially white ink; and executing an instruction to insert a second set of blank layers above the one or more layers of substantially white ink before printing the first plurality of layers of the image.

* * * * *